US009587458B2

(12) United States Patent
Derby

(10) Patent No.: US 9,587,458 B2
(45) Date of Patent: Mar. 7, 2017

(54) SPLIT FOLDBACK RINGS WITH ANTI-HOOPING BAND

(71) Applicant: Weatherford/Lamb, Inc., Houston, TX (US)

(72) Inventor: Michael C. Derby, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 350 days.

(21) Appl. No.: 14/192,703

(22) Filed: Feb. 27, 2014

(65) Prior Publication Data

US 2014/0262351 A1 Sep. 18, 2014

Related U.S. Application Data

(60) Provisional application No. 61/777,523, filed on Mar. 12, 2013.

(51) Int. Cl.
*E21B 33/12* (2006.01)

(52) U.S. Cl.
CPC ..... *E21B 33/1216* (2013.01)

(58) Field of Classification Search
CPC ..... E21B 33/1208; E21B 33/1216
USPC ..... 277/336, 341
See application file for complete search history.

(56) References Cited

U.S. PATENT DOCUMENTS 1,735,264 A * 11/1929 Crickmer ..... E21B 37/10 166/202
4,852,394 A 8/1989 Goans
5,540,279 A * 7/1996 Branch ..... E21B 33/1204 166/118
5,603,511 A 2/1997 Keyser, Jr. et al.
5,676,384 A 10/1997 Culpepper
5,701,959 A * 12/1997 Hushbeck ..... E21B 33/1293 166/118
6,598,672 B2 7/2003 Bell et al.
7,963,321 B2 6/2011 Kutac
8,403,036 B2 * 3/2013 Neer ..... E21B 33/1216 166/118

(Continued)

FOREIGN PATENT DOCUMENTS

WO 0246573 6/2002
WO 2011/020987 A2 2/2011

OTHER PUBLICATIONS

Weatherford, "Swellables Product Range: Well Construction Products Sales Seminar," obtained from www.weatherford.com, (c) 2010, 38 pages.

(Continued)

*Primary Examiner* — Robert E Fuller
*Assistant Examiner* — David Carroll
(74) *Attorney, Agent, or Firm* — Blank Rome, LLP

(57) ABSTRACT

A device and method prevent damage to an anti-extrusion device on a tool, such as a plug or a packer, prior to and during setting of the tool. Typically, the upper or outer edges of the anti-extrusion device are relatively delicate. A reinforcing band on the device's sheath strengthens or armors the upper or outer edge of the anti-extrusion device so the anti-extrusion device may be protected while running the tool into the well or casing. Longitudinal slots on the sheath allow the sheath to expand at least partially with the expansion of the sealing element, while the reinforcing band resists expansion of the distal edge of the sheath.

22 Claims, 6 Drawing Sheets

(56) References Cited

U.S. PATENT DOCUMENTS

| | | | | |
|---|---|---|---|---|
| 9,133,681 | B2 * | 9/2015 | Smith | E21B 33/1216 |
| 2002/0043368 | A1 * | 4/2002 | Bell | E21B 33/1216 166/118 |
| 2004/0007366 | A1 | 1/2004 | McKee et al. | |
| 2007/0261863 | A1 | 11/2007 | MacLeod | |
| 2008/0060821 | A1 | 3/2008 | Smith et al. | |
| 2009/0255690 | A1 | 10/2009 | Conner et al. | |
| 2009/0277648 | A1 | 11/2009 | Nutley et al. | |
| 2010/0038074 | A1 | 2/2010 | Patel | |
| 2010/0276137 | A1 | 11/2010 | Nutley et al. | |
| 2011/0147012 | A1 | 6/2011 | Nutley et al. | |
| 2011/0297368 | A1 | 12/2011 | Lembcke | |
| 2012/0018143 | A1 | 1/2012 | Lembcke | |
| 2012/0037355 | A1 | 2/2012 | Bishop et al. | |
| 2012/0073830 | A1 | 3/2012 | Lembcke | |
| 2012/0133098 | A1 | 5/2012 | Farquhar | |
| 2012/0152568 | A1 | 6/2012 | Nutley et al. | |
| 2012/0217025 | A1 | 8/2012 | Shkurti et al. | |

OTHER PUBLICATIONS

Schlumberger, "HSP-1 Hydraulic-Set Permanent Packer," obtained from www.slb.com/completions, (c) 2009, brochure No. 09-CO-0098, 2 pages.

Weatherford, "Packers Catalog: Discover Premium Performance," obtained from www.weatherford.com, (c) 2005-2010, Brochure No. 667.03, 128 pages.

Weatherford, "Swellable Well Construction Products: NEMISIS Annulus Swellable Packer for Well Construction Applications," obtained from www.weatherford.com, (c) 2011, Brochure No. 8993.00, 2 pages.

Weatherford, "Openhole Completions: Ceres Hydraulic Openhole Packer," obtained from www.weatherford.com, (c) 2011, Brochure No. 9344.00, 2 pages.

Patent Examination Report No. 1 in counterpart Australian Appl. 2014249161, dated Feb. 2, 2016, 2-pgs.

Int'l Preliminary Report on Patentability in counterpart PCT Appl. PCT/US2014/023119, dated Feb. 3, 2015, 10-pgs.

First Office Action in counterpart Canadian Appl. 2,905,815, dated Aug. 15, 2016, 3-pgs.

* cited by examiner

SPLIT FOLDBACK RINGS WITH ANTI-HOOPING BAND

CROSS-REFERENCE TO RELATED APPLICATIONS

This application claims the benefit of U.S. Provisional Appl. No. 61,777,523, filed 12 Mar. 2013, which is incorporated herein by reference.

BACKGROUND

In connection with the completion of oil and gas wells, it is frequently necessary to utilize plugs, packers, or other sealing tools in both open and cased boreholes. The walls of the well or casing are plugged or packed from time to time for a number of reasons. For example, a section of the well may be packed off so pressure can be applied to a particular section of the well, such as when fracturing a hydrocarbon bearing formation, while protecting the remainder of the well from the applied pressure.

A sealing element on a tool, such as a packer or a plug, typically has an initial diameter to allow the tool to be run into the well. The sealing element is then expanded to a radially larger size to seal in the wellbore. Such a tool typically consists of a mandrel about which other portions of the tool are assembled. For example, a fixed gage ring is attached to the lower end of the mandrel, and a push ring slidably surrounds the upper end of the mandrel. If desired, a slip assembly can be used on the mandrel to lock the tool longitudinally in place in the well. In any event, a sealing element is disposed on the mandrel between the fixed gage ring and the push ring. When compressed between the rings, the sealing element creates a seal between the mandrel and the surrounding wall, thereby preventing fluid flow past the tool.

Typically, when the tool is set, the mandrel is held in place and force is applied to the push ring. The push ring moves towards one end of the mandrel, causing the various parts of the tool's sealing element to be longitudinally compressed but radially expanded. As the push ring slides down the mandrel, the sealing element is compressed longitudinally. Most sealing elements are an elastomeric material, such as rubber. When compressed longitudinally, the sealing element tends to then expand radially to form a seal with the well or casing wall.

Unfortunately, the sealing element's expansion may not be limited to only being radially outward. Instead, due to the forces applied during expansion or the force of the pressurized fluid upon the sealing element, the sealing element may extrude longitudinally along the tool through the spaces between the fixed gage ring and the well wall and/or between the push ring and the well wall. Due to the unwanted possibility of extrusion, anti-extrusion rings can be used to prevent the sealing element from extruding beyond the fixed gage ring or push ring, which would cause the tool to fail. Such anti-extrusion rings are employed along the mandrel between the ends of the sealing element and any push or gage rings or other components on the tool.

The anti-extrusion rings may be an elastomeric material, such as nylon, that may not seal as well as the sealing element. However, the anti-extrusion rings may deform enough to prevent the sealing element form extruding to the point of failure. In some instances, metal materials, such as lead, copper, or steel, have been used as well for anti-extrusion rings.

One common structure used for an anti-extrusion device is a cup. The cup fits against the end of the sealing element so that the element's end fits partially in the interior of the cup. The outer bottom of the cup fits against a gage ring or push ring. As the sealing element expands, the cup opens by splaying into a petal like arrangement. The expanded cup or petals tend to limit the longitudinal expansion of the sealing element. To increase the efficiency of the anti-extrusion device, multiple layers of cups may overlay one another so that any gaps, such as between the petals of a split cup, will be overlapped by the adjacent cup.

For example, a downhole tool 10 having a cup-style anti-extrusion ring 20 according to the prior art is shown in FIG. 1A. The downhole tool 10 is an open-hole packer having a mandrel 12 on which are disposed a hydraulic piston 14 and an end ring 16. A sealing element 18 is disposed between a push ring 15 of the piston 14 and the end ring 16. When moved by the piston 14, the push ring 15 compresses the sealing element 18 longitudinally against the end ring 16, which causes the sealing element 18 to expand out radially.

Cup-style rings 20 are provided on the ends of the sealing element 18 at the push and end rings 15, 16. These Cup-style rings 20 help prevent over-extrusion of the sealing element 18. For example, FIG. 1B depicts a side cut away view of a prior art anti-extrusion ring 20 after the sealing element 18 has been expanded against the casing C and the mandrel 12 to seal the annular area A, thereby preventing fluid flow past the tool 10. As the sealing element 18 expands radially outward, the leading edge 26 of the sheath 22 of the prior art anti-extrusion ring 20 is also pushed radially outward to contact the casing C.

Further details of the cup-style ring 20 are provided in cross-section in FIG. 1C. This ring 20 is a petal-style foldback ring having a number of petals 22 connected at their proximal ends by a neck 24 and separate by gaps or slots 26 toward their distal ends. During use, the petal-style ring 20 opens by splaying into a petal-like arrangement as discussed above.

Another cup-style ring 30 shown in FIG. 1D lacks petals and does not splay open into a petal-like arrangement. Instead, this ring 30 has a widened sidewall 32 that fits partially along the outside surface of the sealing element (18) and the element's end. The sidewall 32 extends over the end of the sealing element (18) from a wider neck 34 that fits at the mandrel (12) and push or end ring (15, 16) of the packer (10). The distal end of the sidewall 32 has an integrally formed lip 36, which is rounded in shape. As can be particularly seen, the thickness of the sidewall 32 lessens from the wider neck 34 to the lip 36.

Unfortunately, cups may be easily damaged as they are run into a well. Additionally, they may be damaged during setting when they are radially expanded into sealing contact with the well or after the element and cups are set because the tool may move longitudinally due to varying forces acting on the tool in the wellbore. Therefore, a need exists for an anti-extrusion device that tends to limit or prevent any damage to the anti-extrusion device during run-in and use downhole.

SUMMARY

An anti-extrusion device according to the present disclosure has a slotted foldback ring with an anti-hopping band. The device installs adjacent a sealing element on a sealing tool, such as a plug or a packer. Features of the device prevent damage to the end of the device while run into the well and when expanded. Typically, the distal edges of an anti-extrusion device are relatively delicate. To protect the disclosed anti-extrusion device, the distal edge is strengthened or armored so the anti-extrusion device may be protected while running the tool into the well or casing. The anti-extrusion device can also be protected as the tool moves in the wellbore due to a variety of forces such as pressure and temperature that act upon the tool once set.

In one embodiment, the anti-extrusion device for use on a downhole tool, such as a plug or a packer, in a wellbore has a proximal edge or inner ring disposed on the tool adjacent to an end of the sealing element. A sheath extends from the inner ring and has a distal edge disposed at least partially over the end of the sealing element. A reinforcing band is disposed on the distal edge of the sheath. The sheath has longitudinal slots (i.e., slits or burst lines). The reinforcing ring may be a solid round ring or a solid flat ring, and the sheath may be metallic, plastic, or some other material.

In a method of restraining a sealing element on a downhole tool, an anti-extrusion ring overlaps a portion of the sealing element. The anti-extrusion ring has a reinforcing band on its leading edge to protect the anti-extrusion ring. The sealing element, the anti-extrusion ring, and the reinforcing ring are run together into a well. Once the anti-extrusion ring, the sealing element and the reinforcing ring are properly located, the sealing element may be expanded as the anti-extrusion ring restrains the sealing element.

The subject matter of the present disclosure is directed to overcoming, or at least reducing the effects of, one or more of the problems set forth above.

DETAILED DESCRIPTION OF EMBODIMENTS

The description that follows includes exemplary apparatus, methods, techniques, and instruction sequences that embody techniques of the inventive subject matter. However, it is understood that the described embodiments may be practiced without these specific details.

Figure 1A:
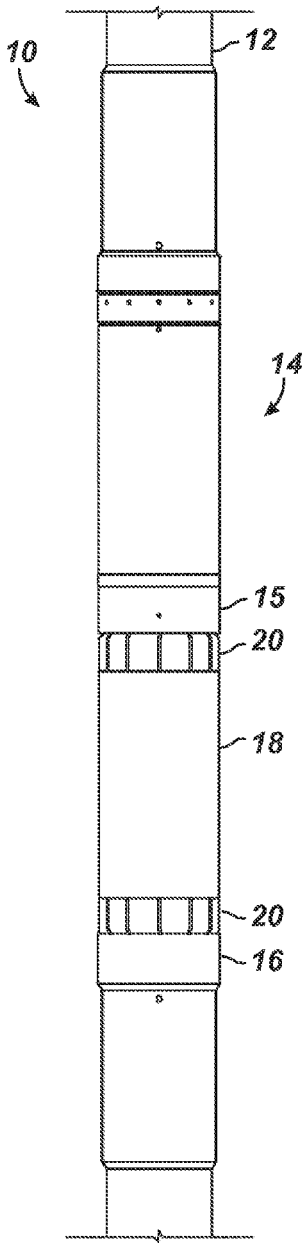
Figure 1A (Prior Art)
FIG. 1A depicts an elevational view of an open-hole packer having anti-extrusion rings according to the prior art.
Figure 1B:
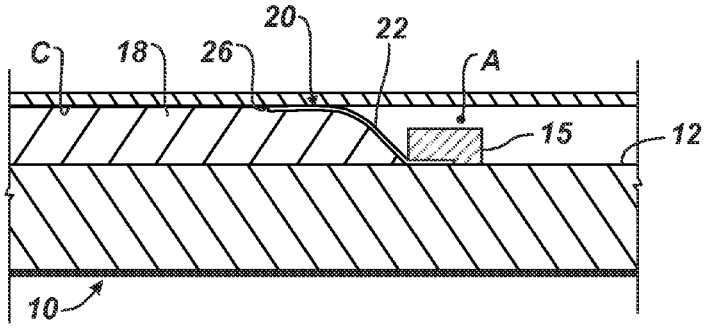
Figure 1B (Prior Art)
FIG. 1B depicts an anti-extrusion ring according to the prior art in an expanded condition relative to a compressed sealing element on a mandrel.
Figure 1C:
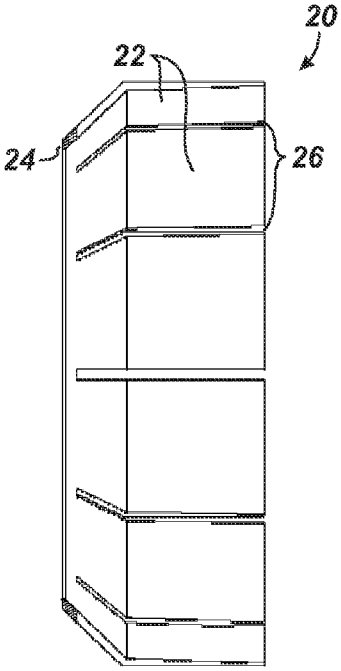
Figure 1C (Prior Art)
FIG. 1C depicts a side cross-section of a prior art anti-extrusion ring.
Figure 1D:
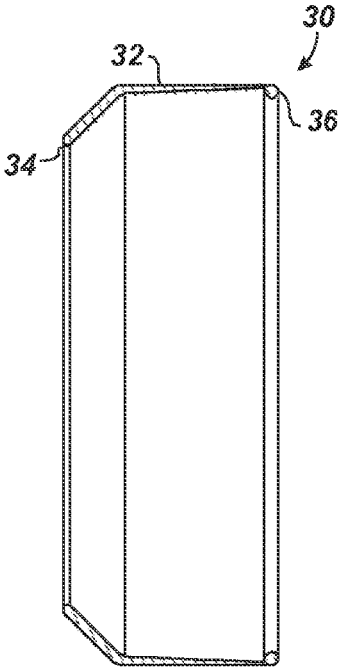
Figure 1D (Prior Art)
FIG. 1D depicts a side cross-section of a prior art cup-style ring.
Figure 2:
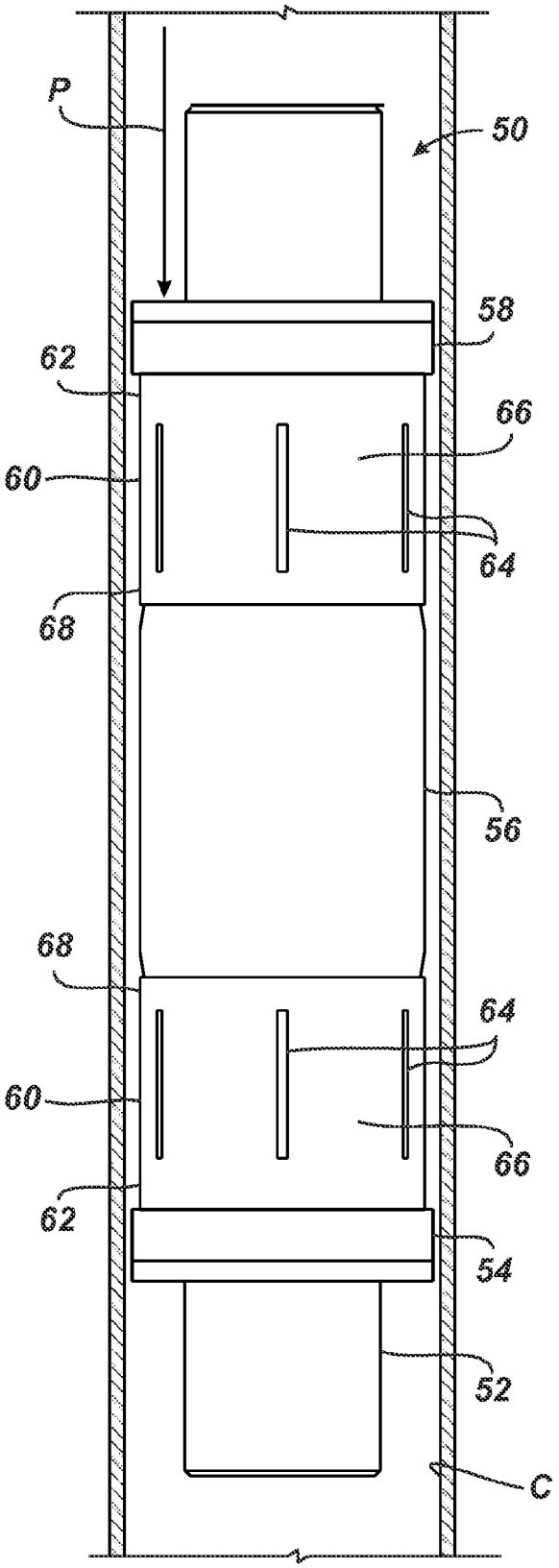
FIG. 2 depicts a downhole tool, such as a packer or a plug, having anti-extrusion devices according to the present disclosure.

FIG. 2 depicts a downhole tool 50, such as a plug, a packer, or the like, in an unset or run-in condition in casing C (although the tool 50 can be used in an open hole). The tool 50 has a mandrel 52, an end gage ring 54, a sealing element 56, and a push ring 58. The end gage ring 54 is fixed to the lower end of the mandrel 52 and may be secured to the mandrel 52 using known techniques. The push ring 58 as well as the sealing element 56 are movable along the outside of the mandrel 52. In this way, a setting tool (not shown) can be used to hold the mandrel 52 and push the push ring 58 toward the fixed ring 54, causing the sealing element 56 to be compressed and expand radially.

In general, the sealing element 56 may be an elastomer or any other material that may be relatively easily deformed. Moreover, although the sealing element 16 has been described above as a compressible element, other types of sealing elements, such as a swellable sealing element, can be used and benefit from the teachings of the present disclosure.

To prevent extrusion of the sealing element 56 through the annular spaces between the rings 54 and 58 and the casing C and into the annulus spaces between the mandrel 52 and the casing C, the tool 50 uses anti-extrusion devices 60 according to the present disclosure. One device 60 fits at one (downhole) end of the tool 50 between the end of the sealing element 56 and the fixed gage ring 54, while another device 60 fits at the other (uphole) end between the opposite end of the sealing element 56 and the push ring 58.

Each anti-extrusion device 60 has a number of slots 64 formed into it to allow the middle section 66 to expand radially outward. The proximal section 62 may be relatively solid to prevent the proximal section 62 from expanding radially, thereby maintaining an anti-extrusion seal against the mandrel 52. The distal section 68 may be relatively solid to prevent the distal section 68 from expanding radially outward. By having a relatively solid distal section 68, the anti-extrusion device 60 is able to resist tearing or snagging as the tool 50 is run into the wellbore. In some instances, it may be desired to allow the distal section 68 to radially expand a certain amount. In these instances, the distal section 68 may have a separate set of expansion slots, or it may be reinforced by a reinforcing ring, where the reinforcing ring could be stretchable, split, or split with overlapping rings.

The slots 64 are typically longitudinally elongated slits or splits cut through the material of the device 60, but they could also be perforations, indentations, thinned areas, score lines, etc. (e.g., "burst lines") formed partially through or on the anti-extrusion device 60 to allow the middle section 66 to split along the slots 64, which would allow the anti-extrusion device 60 to expand against the wellbore or casing C and prevent the sealing element 56 from extruding past the anti-extrusion device 60. In some instances, it may be desirable to overlap multiple anti-extrusion devices 60 on top of one another at each end of the sealing element 56 so that any gaps formed by the slots 64 in one layered device 60 are overlapped by the petals of the device 60 in an adjacent layer.

When the tool 50 is a plug and is set in position downhole, a setting tool (not shown) is secured to the mandrel 52 and applies force in the direction of arrow P to the push ring 58. Where the tool 50 is a packer and is set in position downhole, the components for setting the element would be part of the packer's assembly so that a separate setting tool may not be used. Either way, as the push ring 58 is forced downwards along the mandrel 52, each of the slidably mounted components is also moved longitudinally downwards against the fixed gage ring 54. A locking mechanism (not shown) may typically be used to hold the push ring 58 in place on the mandrel 52 once forced downward.

At the same time, the sealing element 56 is longitudinally compressed and expands radially outwards to seal against both the mandrel 52 and the casing C, sealing the exterior of the mandrel 52 to fluid flow in either direction. As the sealing element 56 expands radially outward, portions of the sealing element 56 may tend to extrude longitudinally. The anti-extrusion devices 60 tend to limit the extrusion of the sealing element 56.

Figure 3B:
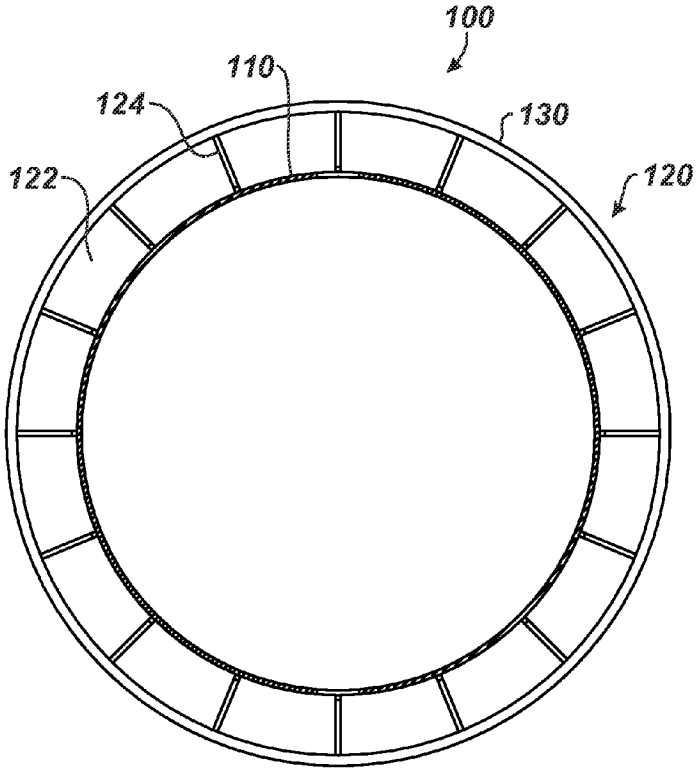
FIG. 3B depicts an end-sectional view of the anti-extrusion device of FIG. 3A.
Figure 3A:
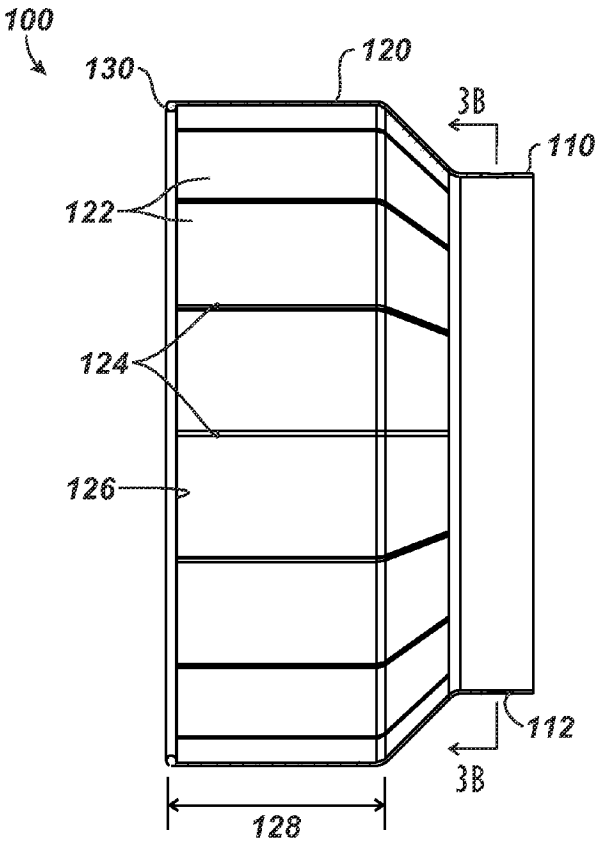
FIG. 3A depicts a cross-sectional view of an anti-extrusion device according to the present disclosure.
Figure 3C:
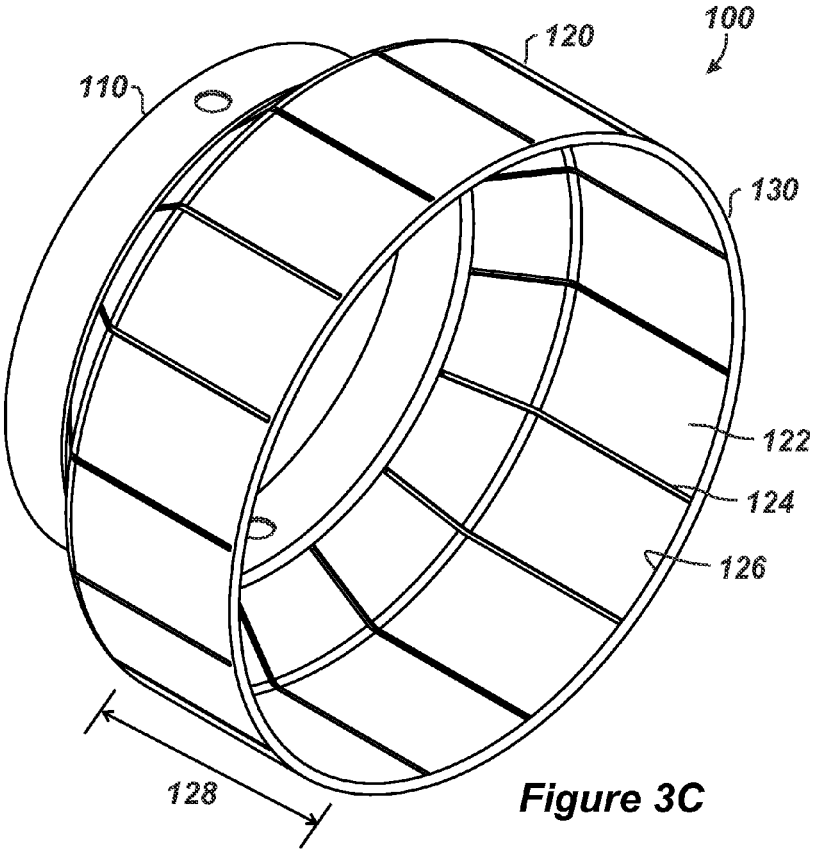
FIG. 3C depicts an orthogonal view of the anti-extrusion device of FIG. 3A.

FIGS. 3A-3C depict an embodiment of an anti-extrusion device 100 according to the present disclosure. FIG. 3A depicts a cross-sectional view of the anti-extrusion device 100, FIG. 3B depicts an end-sectional view of the anti-extrusion device 100, and FIG. 3C depicts an orthographic view of the anti-extrusion device 100.

The anti-extrusion device 100 has an inner ring 110 at a proximal end or edge, a sheath 120 in a middle section, and a reinforcing ring or band 130 at a distal end or edge. The band 130 reinforces the distal edge 126 of the sheath 120 and, as noted herein, acts as anti-hooping band. The inner ring 110 is mounted on a tool's mandrel, such as the mandrel 52 from FIG. 2, and may have fastener holes 112 or the like. If used adjacent a fixed gage ring or other component, the inner ring 110 may be fixedly held on the mandrel 52. If used adjacent a push ring or other movable component, the inner ring 110 may be slidably mounted on the mandrel 52.

The sheath 120 extends from the inner ring 110, and has the distal edge 126 where the reinforcing band 130 is attached. When placed on a tool prior to the tool being set, the reinforcing band 130 and the sheath 120 fit over the end of the sealing element, such as sealing element 56 from FIG. 2.

A distal portion of the sheath 120, nearest to the reinforcing band 130 tends to have a relatively uniform diameter for a set longitudinal distance, such as distance 128. This distance 128 is typically the distance that the anti-extrusion device 100 overlaps the sealing element 56. The proximal portion of the sheath 120 nearest to the inner ring 110 has a rapidly diminishing diameter where it attaches to the inner ring 110.

Slots 124 are defined around the circumference of the sheath 120. The slots 124 can be cut, formed, molded, or otherwise produced in the material of the sheath 120. Typically, the slots 124 are disposed longitudinally along the sheath 120 and may extend from the inner ring 110 to the reinforcing band 130. The slots 124 can be full slits or perforations defined through the material of the sheath 120. In other instances, the slots 124 may not perforate through the material of the sheath 120. Instead, the slots 124 may be creased, cut, or molded areas of reduced thickness, such as burst lines, in the sheath material so that the sheath material may break to form split slits when expanded. Either way, the sheath 120 may form a number of petals 122 upon expansion of the sealing element 56.

The anti-extrusion device 100 can be composed of plastic, metal, other material, or a combination thereof. The inner ring 110 and the sheath 120 may be integrally formed as one piece, while the reinforcing band 130 can be a separate component affixed, fused, embedded, molded, or otherwise attached to the distal end of the sheath 120. The reinforcing band 130 may in fact be formed as a metal ring with a round, flat, or other cross-section that is molded, embedded, or affixed to the distal edge 126 of the sheath 120, which may be formed of the same or different material. In another alternative, the inner ring 110 can be a flat metal ring affixed or disposed on the proximal end of the sheath 120. In yet another alternative, the reinforcing band 130 can be integrally formed with the sheath 120 as one piece.

Figure 4:
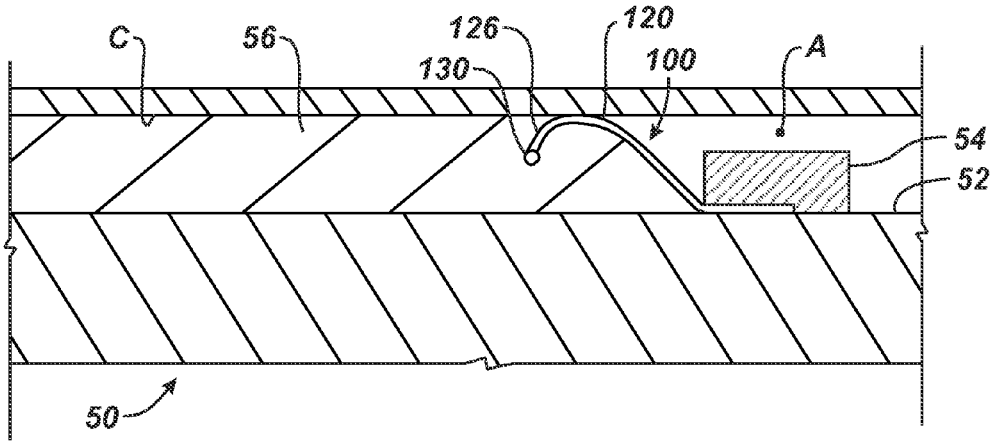
FIG. 4 depicts the anti-extrusion device according to the present disclosure in an expanded condition relative to a compressed sealing element on a mandrel.

In FIG. 4, an embodiment of the anti-extrusion device 100 according to the present disclosure is depicted in a side cut away view. The sealing element 56 has been expanded against the casing C and the mandrel 52 to seal the annular area A, thereby preventing fluid flow past the tool 50. Prior to its radial expansion, the sealing element 56 and the anti-extrusion device 100 were arranged so that a portion of the sheath 120 as well as the reinforcing band 130 on the leading edge 126 of the sheath 120 overlaid a portion of the exterior of an end of the sealing element 56.

As the sealing element 56 radially expands, the sealing element 56 causes the portion of the sheath 120 to move radially outward to contact the casing C, thereby preventing the sealing element 56 from extruding past the point where the anti-extrusion device 100 contacts the casing C.

As discussed previously, the leading edge 126 of the sheath 120 of the anti-extrusion device 100 is attached to the reinforcing band 130. During run-in and after the sealing element 56 has been expanded, the reinforcing band 130 protects the leading edge 126 from snags that the leading edge 126 may encounter as it moves in the wellbore. The reinforcing band 130 also tends to limit the leading edge 126 from expanding with the sealing element 56 radially outwards to an extent towards the casing C that in certain instances may cause the anti-extrusion device 100 to have the appearance of a cresting wave in cross-section. In certain embodiments, the reinforcing band 130 may be of an expandable type of material or may be split to allow the leading edge 126 to expand at least to some extent with the sheath 120 and the sealing element 56. It may also be desirable to have the reinforcing band 130 comprise overlapping reinforcing rings.

Figure 5B:
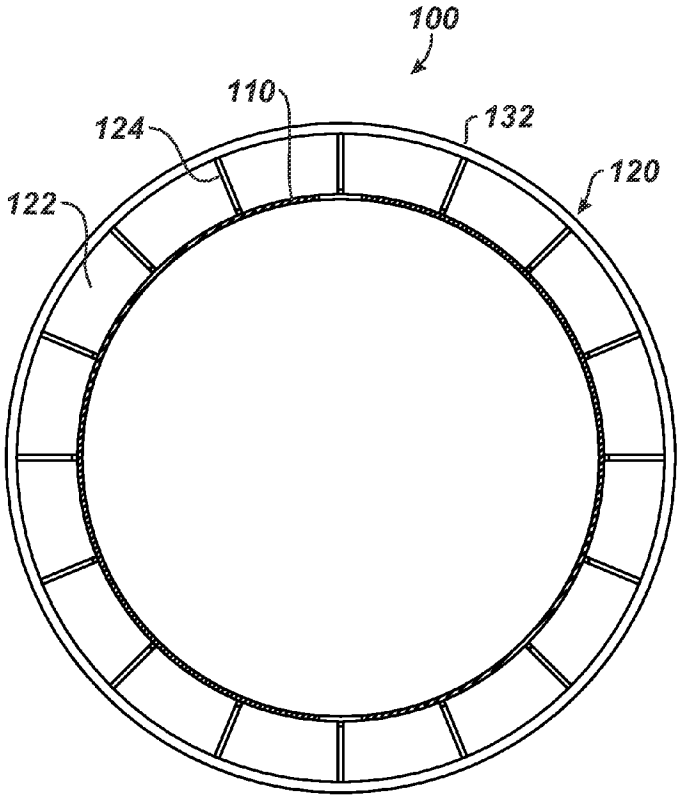
FIG. 5B depicts an end-sectional view of the anti-extrusion device of FIG. 5A.
Figure 5A:
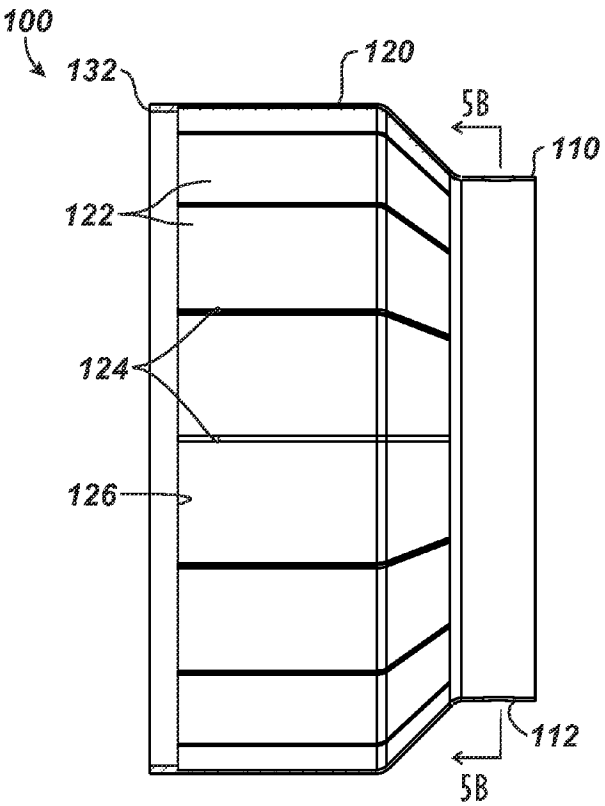
FIG. 5A depicts a cross-sectional view of another anti-extrusion device according to the present disclosure.

FIGS. 5A and 5B show another embodiment of an anti-extrusion device 100 according to the present disclosure. Rather than having a separate or round reinforcing band 130, the device 100 of FIGS. 5A-5B has a reinforcing area 132 at the distal edge 126 of the sheath 120. This reinforcing area 132 is not slotted and may not have an area of reduced diameter. In some instances, this reinforcing area 132 may be radially thicker than the adjacent leading edge 126.

Again, the anti-extrusion device 100 can be composed of plastic, metal, other material, or a combination thereof. The inner ring 110 and the sheath 120 may be integrally formed as one piece, while the reinforcing area 132 can be a separate component affixed, fused, embedded, molded, or otherwise attached to the distal end of the sheath 120. The reinforcing band 130 may in fact be formed as a metal ring with a flat cross-section. Also, the reinforcing band 130 may also be integrally formed with the inner ring 110 and the sheath 120.

In some instances, it may be desirable to mount multiple anti-extrusion devices 100 adjacent to one another, but have the slots 124 of each anti-extrusion device 100 offset from an adjacent anti-extrusion device 100 on the tool's mandrel 52. By mounting multiple anti-extrusion devices 100 adjacent to one another in this way, any gaps 124 between the petals 122 of one anti-extrusion device 100 can be covered by the petals 122 of the adjacent anti-extrusion device 100.

Figure 6B:
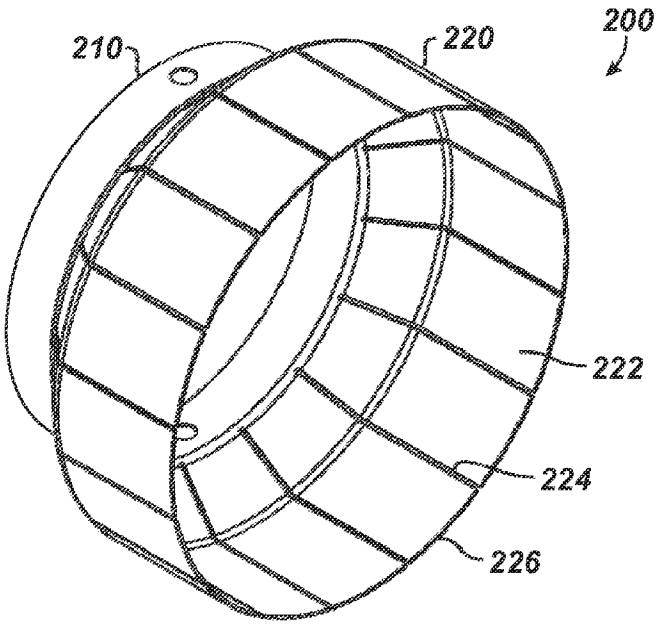
FIG. 6B depicts a perspective view of the inner member of the anti-extrusion device of FIG. 6A.
Figure 6A:
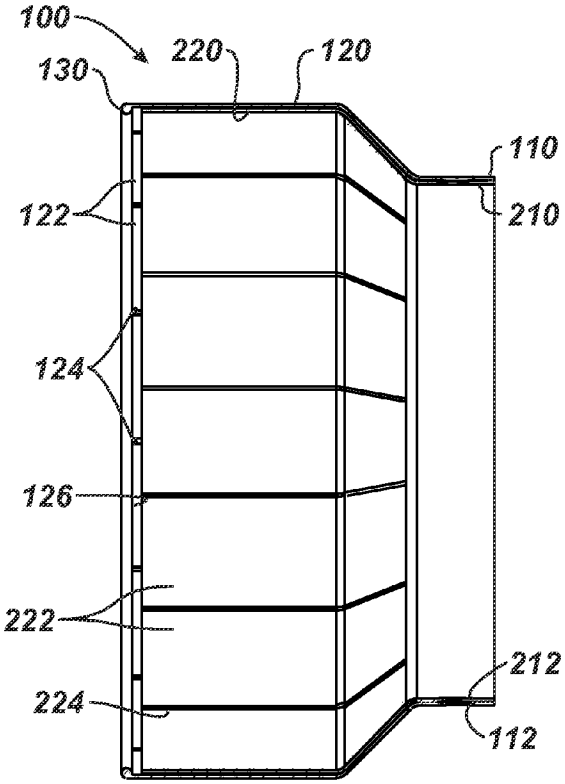
FIG. 6A depicts a cross-sectional view of another anti-extrusion device according to the present disclosure.

As one example, FIG. 6A depicts a cross-sectional view of another anti-extrusion device according to the present disclosure for use on one end of a sealing element (not shown). This device includes an inner device 200 disposed between an outer device 100 and the sealing element (not shown). The outer device 100 can be similar to those disclosed above having the reinforcing ring or band 130. The inner device 200 can also be the same and can have such a reinforcing band (not shown).

As depicted in FIG. 6A, however, the inner device 200 may lack a reinforcing band. Instead, as best shown in the isolated perspective of FIG. 6B, the inner anti-extrusion device 200 includes an inner ring 210 at a proximal end and a sheath 220 at an opposing end. The inner ring 210 is mounted on a tool's mandrel, such as the mandrel 52 from FIG. 2, and may have fastener holes 212 or the like. If used adjacent a fixed gage ring or other component, the inner ring 210 may be fixedly held on the mandrel 52. If used adjacent a push ring or other movable component, the inner ring may be slidable mounted on the mandrel 52.

The sheath 220 extends from the inner ring 210 and has a distal edge 226. When placed on a tool prior to the tool being set, the distal edge 226 and the sheath 220 fit over the end of the sealing element, such as sealing element 56 from FIG. 2. As shown, the distal edge 226 of the sheath 220 lacks a reinforcing ring in this embodiment. Instead, the slots 224 (e.g., slits or burst lines) are defined on the sheath 220 from the inner ring 210 to the device's distal edge 226 so that the inner device 200 has a number of free petals 222.

With the inner device 200 disposed inside of the outer device 100 as shown in FIG. 6A, the inner device's distal edge 226 is preferably shorter than the extent of the outer device 100. In this way, the reinforcing band 130 on the outer device 100 can overlap further on the sealing element (not shown) when disposed adjacent thereto. As further noted above and as shown in FIG. 6A, the slots 224 (slits or burst lines) in the inner sheath 220 are preferably radially misaligned with the slots 124 (slits or burst lines) in the outer sheath 120, although other arrangements are possible. For instance, the inner and outer devices 100 and 200 may have different numbers of slots 124 and 224 and may be offset from one another in different configurations.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. An anti-extrusion device for use on a downhole tool having a sealing element, the device comprising:

a first proximal edge disposed on the downhole tool adjacent an end of the sealing element;

a first sheath extending from the first proximal edge and having a first distal edge, the first distal edge disposed at least partially over the end of the sealing element, the first sheath defining one or more first longitudinal slots at least partially between the first proximal edge and the first distal edge; and a reinforcing band disposed on the first distal edge of the first sheath.

2. The device of claim 1, wherein the first proximal edge comprises an inner ring disposed on the downhole tool adjacent the end of the sealing element.

3. The device of claim 1, wherein the one or more first longitudinal slots comprise at least one of: one or more slits defined through the first sheath, and one or more burst lines defined at least partially in the first sheath.

4. The device of claim 1, wherein the reinforcing band comprises a continuous ring disposed about the first distal edge.

5. The device of claim 1, wherein the first sheath comprises a metallic material, a plastic material, or a combination thereof.

6. The device of claim 1, wherein the reinforcing band is integrally formed with the first distal edge of the first sheath.

7. The device of claim 1, further comprising a second sheath disposed on the downhole tool between the first sheath and the sealing element, the second sheath having a second proximal edge and having a second distal edge, the second distal edge disposed at least partially over the end of the sealing element.

8. The device of claim 7, wherein the second sheath defines one or more second longitudinal slots being radially misaligned with the one or more first longitudinal slots.

9. The device of claim 1, wherein the reinforcing band disposed on the first distal edge of the first sheath comprises a rigidity greater than the first sheath.

10. A downhole tool, comprising:

a sealing element disposed on the downhole tool and adapted to expand; and a first device for limiting extrusion of the sealing element, the first device at least including— a first proximal edge disposed on the downhole tool adjacent an end of the sealing element, a first sheath extending from the first proximal edge and having a first distal edge, the first distal edge disposed at least partially over the end of the sealing element, the first sheath defining one or more first longitudinal slots at least partially between the first proximal edge and the first distal edge, and a reinforcing band disposed on the first distal edge of the first sheath.

11. The tool of claim 10, wherein the first proximal edge comprises an inner ring disposed on the downhole tool adjacent the end of the sealing element.

12. The tool of claim 10, wherein the one or more first longitudinal slots comprise at least one of: one or more slits defined through the first sheath, and one or more burst lines defined at least partially in the first sheath.

13. The tool of claim 10, wherein the reinforcing band comprises a continuous ring disposed about the first distal edge of the first sheath.

14. The tool of claim 10, wherein the first sheath comprises a metallic material, a plastic material, or a combination thereof.

15. The tool of claim 10, wherein the reinforcing band is integrally formed with the first distal edge of the first sheath.

16. The tool of claim 10, further comprising a second device for limiting extrusion of the sealing element, the second device disposed between the sealing element and the first device.

17. The tool of claim 14, wherein the second device comprises a second sheath disposed on the downhole tool between the first sheath and the sealing element, the second sheath having a second proximal end and having a second distal edge, the second distal edge disposed at least partially over the end of the sealing element.

18. The tool of claim 15, wherein the second sheath defines one or more second longitudinal slots being radially misaligned with the one or more first longitudinal slots.

19. A method of restraining a sealing element on a downhole tool, the method comprising:

overlapping a portion of the sealing element with a first sheath of a first anti-extrusion device;

protecting a first leading edge of the first sheath of the first anti-extrusion device with a reinforcing band;

running the downhole tool into a well;

expanding the sealing element on the downhole tool in the well; and restraining the expansion of the sealing element with the first anti-extrusion device by at least partially expanding the first sheath along one or more longitudinal slots defined between the reinforcing band and a trailing edge of the first sheath.

20. The method of claim 19, wherein protecting the first leading edge of the first anti-extrusion device with the reinforcing band comprises integrally forming the reinforcing band on the first leading edge of the first anti-extrusion ring.

21. The method of claim 19, wherein overlapping the portion of the sealing element with the first anti-extrusion device comprises disposing a second anti-extrusion device between the sealing element and the first anti-extrusion device.

22. The method of claim 21, wherein disposing the second anti-extrusion device between the sealing element and the first anti-extrusion device comprises radially misaligning longitudinal slots in the first and second anti-extrusion devices.

* * * * *